United States Patent [19]

Hibbard

[11] 4,213,549

[45] Jul. 22, 1980

[54] WATERPROOF STORAGE BAG AND BACKPACK

[75] Inventor: Linda A. Hibbard, Boulder, Colo.

[73] Assignee: Phoenix Products, Inc., Tyner, Ky.

[21] Appl. No.: 49,941

[22] Filed: Jun. 18, 1979

[51] Int. Cl.[3] ..... A45F 3/04; B65D 30/10

[52] U.S. Cl. ..... 224/209; 224/153; 224/236; 150/3; 150/7

[58] Field of Search ..... 224/209, 214, 236, 250, 224/257, 259, 153; 150/3, 7, 43

[56] References Cited

U.S. PATENT DOCUMENTS

| | | | |
|---|---|---|---|
| 2,276,087 | 3/1942 | Peterson | 150/7 X |
| 2,407,787 | 9/1946 | Kernahan | 224/236 X |
| 3,622,056 | 11/1971 | Droeger | 224/209 X |
| 3,838,758 | 10/1974 | Brown | 150/3 X |
| 4,057,854 | 11/1977 | Phelps, Sr. | 224/153 X |

*Primary Examiner*—Steven M. Pollard

*Attorney, Agent, or Firm*—Wood, Herron & Evans

[57] ABSTRACT

A waterproof storage bag and backpack is provided with a harness and harness mounting grommets in such position to permit the harness to cradle the bag and load therein without tearing the bag or the grommet areas, to enhance the top closure seal, and to permit the bag to be opened without removal of the harness.

11 Claims, 1 Drawing Figure

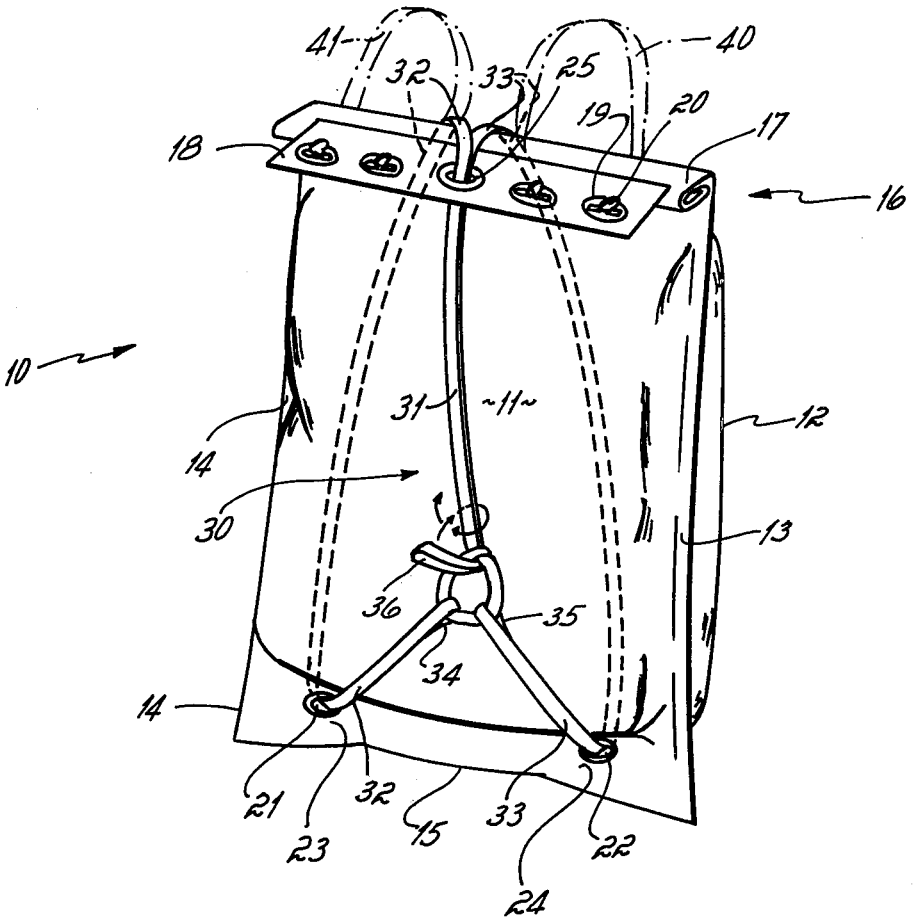
41
40
32
33
25
19
20
17
18
16
10
31
11
12
14
30
13
36
35
34
14
21
32
15
33
22
23
24

WATERPROOF STORAGE BAG AND BACKPACK

BACKGROUND OF THE INVENTION

This invention relates to storage bags and more particularly to waterproof storage bags of the type used by canoeists or rafters, for example.

Sporting enthusiasts who travel various waterways have need for waterproof storage bags to maintain their gear in a dry, assembled condition. In many cases these enthusiasts travel turbulent, fast water or "white" water sections of rivers and streams in kayaks, canoes or rafts. Waterproof bags are required to keep their gear dry against water spray or against dumping in the event the conveyance overturns or heels over.

Such bags as are generally known usually have front and rear sides, sealed around the edges except at a top closure where access to the bag is provided. To retain the bag's watertight integrity, the top closure is usually folded or rolled and held against unfolding by straps or the like. In one form of prior bag made by the applicant, a closure flap is provided for overlaying the rolled top closure. The closure flap is then secured to the front side of the bag, to hold the top closure seal, by means of turn-tabs or the like.

In some instances, such bags are used to transport gear from boat to camp, or during portages, for example. In these cases, certain efforts have been made to provide carrying straps for the bags. Such attempts have involved securing the strap ends to grommeted apertures in the bag's sealed edges.

Such construction is rather frail, however, for continued lifting or movement of the bag by the straps pulls at the grommet areas, straining the bag edges and seals. This usually and eventually results in a pulling out of the grommet which may rip a hole in the bag, destroying its water-tightness. At the least, the carrying capability of such a bag is usually destroyed or severely hampered.

Accordingly, it has been one objective of this invention to provide an improved storage bag.

A further objective of the invention has been to provide an improved storage bag and harness which does not stress the waterproof facility of the bag when the bag is transported.

A further objective of the invention has been to provide an improved waterproof bag which can be used as a backpack and without incurring undue stress at the points of attachment of the conveying harness to the bag.

A further objective has been to provide an improved waterproof bag with a carrying harness to adapt the bag to backpack use and such that the bag can be opened with the harness in place.

A still further objective of the invention has been to provide an improved waterproof bag and harness with an improved top closure which is held closed by the harness and yet can be opened without removing the harness.

To these ends, a preferred embodiment of the invention includes a waterproof bag having front and rear sides sealed about their edges, except at a top closure portion, and harness securing means extending around the bag through bottom apertures and at least one top aperture in a closure flap of the top closure. In this manner, the harness comprises straps which encircle the bag and actually cradle it around its front side and bottom so that no undue stress is exerted on the aperture areas. Instead, the bag is supported by the harness straps extending around and engaging the bag and the load, and the pulling of the aperture or grommet areas is substantially reduced or even eliminated.

As a result, the lifting or conveying forces are distributed over a large area of the bag and are not localized in a small sealed grommet area such as would be susceptible to tearing. The bag thus retains its waterproof integrity even when heavily loaded or roughly handled to the extent which would rip the grommet areas of previously known bags. The grommeted aperture areas in the invention thus serve to position the harness but do not constitute the major load bearing stress area of the bag.

In another aspect of the invention, the harness straps extend over a portion of the closure flap and top closure such that when the bag is lifted or carried by straps adjacent the rear side of the bag, the straps tend to hold the top closure in a sealed position and do not pull it or stress it in a manner which would weaken it. Even so, the top closure can be opened without removal of the harness.

These and other advantages of the invention will become readily apparent from the following detailed description of a preferred embodiment of the invention and from the drawing of the FIGURE which is a perspective view of a preferred embodiment of the invention.

Turning now to the drawing, there is shown a waterproof bag 10 according to the invention. The bag 10 has a front side 11 and a rear side 12 which are joined together at edges 13 and 14 and at the bottom 15 such as by a heat sealing process. In this connection it will be appreciated that the particular bag shown, by way of describing a preferred embodiment of the invention, is made from an 18 ounce nylon, coated with a vinyl-rubber compound. This particular coated material constitutes a relatively rugged waterproof material which is abrasion resistant and yet which can be heat sealed as described to form the bag.

The bag has a top portion which is not sealed but rather provides a top closure means 16. The top closure means 16 includes a foldable or rollable portion 17 and further a top closure flap 18. The top closure flap 18 is provided with a plurality of grommets 19 for receiving turn-tabs 20 which are mounted on the front side 11 of the bag 10. Thus, a relatively watertight top closure is provided by way of folding and then rolling portion 17 and thereafter securing the closure flap 18 to the front side 11 of the bag over the rolled portion 17.

In an alternate embodiment, the bag could be constructed with a closed top, formed by a seam or a closure flap, and with an operable closure such as that described above, along the side thereof. As will be appreciated, such a bag would provide easy access, even when worn, while maintaining the other advantages noted herein.

The bottom portion 15 of the bag of the preferred embodiment is provided with spaced harness apertures defined by grommets 21 and 22 located in heat sealed areas 23 and 24, respectively. It will be appreciated that the apertures are spaced apart from each other and are also sealed off from the interior portion of the bag, the front and rear sides 11 and 12 being sealed between the grommets 21 and 22 and the interior portion of the bag as illustrated.

The closure flap 18 is also provided in the preferred embodiment with at least one harness aperture defined by the grommet 25 and located centrally of the closure flap. In alternate embodiments, of course, two or more apertures could be provided in the closure flap as desired for double straps of a harness, however, the utilization of one grommet or aperture is entirely suitable.

A strap means or harness means 30 is provided for supporting and carrying the bag and for converting the bag into a transportable backpack. The strap means 30 of the preferred embodiment basically comprises a strap 31 having bifurcated strap portions 32 and 33 as shown in the drawing. In this respect, it will be appreciated that while the strap 31 is referred to as a single strap, it could simply comprise a loop formed by the straps 32 and 33 which tend to begin separating just after the extension through the grommet 25.

Strap 31 extends along the front side 11 of the bag to the grommet 25 where the bifurcated portions split and extend over the top of the bag and down along the rearward side 12 of the bag through the apertures 21 and 22. The strap portions 32 and 33 are thus located on the outer surface of the bag and serve to cradle the bottom portion and the front side of the bag. As shown, the straps 32 and 33 terminate in loops 34 and 35 adjacent the front of the bag. The loops can be joined by tying the loop 36 of the strap 31 therethrough. Alternately, the loops 34, 35 and 36 can simply be joined with a carabiner.

Further in the preferred embodiment, shoulder harness means comprising straps 40 and 41 are attached to the straps 32 and 33 adjacent the rearward side of the bag and provide means by which the bag can be supported on the shoulders of a user. For example, the shoulder harness 40 and 41 is preferably attached to the straps 32 and 33 by means of adjustable buckles or the like (not shown) to render the shoulder harness means adjustable to fit various size wearers and various size loads. Alternately, the shoulder harnesses 40 and 41 can simply be sewed or otherwise attached to the straps 32 and 33.

It will now be appreciated that the strap means 30 encircles and surrounds the interior carrying portion of the bag when the bag is lifted from the rearward side 12, such as by the shoulder harnesses 41 or 42 or the straps 32 and 33. The strap 31 and the portions of the straps 32 and 33 which are on the front side of the bag and extend underneath the bag serve to cradle and support the bag and the load therein. It will be appreciated then that no outward forces, or pulling forces, are exerted on the grommet areas 21 and 22 and 25. Rather these grommet areas serve to position the straps rather than to fully support the load within the bag. Relatively large and heavy loads can thus be carried in the bag without exerting a load supporting pulling force on the grommets 21, 22 and 25, for example.

Moreover, it will be appreciated that the strap 31 extends through the grommet 25 and then up and over the top closure 16. When any force is exerted on the straps 32 and 33 such as by lifting the bag by way of the shoulder harnesses 40 and 41, for example, the strap 31 and the bifurcated portions 32 and 33 tend to compress the top closure 16 and hold it in place. Thus, the actual lifting or carrying of the bag does not tend to unduly stress or undo the top closure such as would effect the waterproof seal provided by it, but rather enhance the seal.

It should also be appreciated that more than one grommet 25 could be utilized in the closure flap 18 of the bag. For example, two grommets 25 could be spaced apart in the top closure flap and the straps 32 and 33 run through the respective two grommets to join the ends of the straps 32 and 33 at the lower front area of the bag. Utilization of the single grommet 25, however, provides a fairly simple and less complex strap means.

It should also be appreciated that the preferred embodiment of the present invention provides a waterproof bag which can be opened without removing the strap means 30. For example, in order to open the bag it is only necessary to undo the turn tabs 20 and to lift the closure flap 18 unfolding the folded portion 17. In this regard, the closure flap is free to slide along the straps 31 or 32 and 33 providing clearance for opening the top of the bag for access to its interior, all without requiring the straps to be unfastened from the bag. Of course, it is also possible to open the bag by undoing the loop 36 from the loops 34 and 35 and permitting the strap 31 to slide through the grommet to provide an even greater access opening to the bag.

Accordingly, the invention provides an improved waterproof bag and strap means for utilizing the bag as a backpack. When the bag is filled and lifted by the harness means as described, the lifting forces are distributed over a large area of the front and bottom side of the bag rather than through localized grommets areas. Thus the lifting or transportation of the bag does not tend to pull out the grommets which may rip the bag and cause it to lose its watertightness or at least to destroy or hamper the carrying capabilities of the bag. Moreover, the operation of the harness or strap means as described tends to hold the top closure of the bag in position and to enhance the sealing of the top closure.

Also, a further advantage is provided in that the harness always stays with the bag and does not, in the preferred use, come loose. Loose straps which drag, and lost straps are thus prevented.

These and other advantages and modifications will be readily apparent to those of ordinary skill in the art without departing from the scope of this invention and the applicant intends to be bound only by the claims appended hereto.

I claim:

1. A portable storage bag having enclosed sides and bottom and a top closure having a closure flap, said bag further including:

two spaced apertures in a bottom portion of the bag, said apertures being spaced from an interior of said bag, at least one aperture in said closure flap, and encircling strap means extending through said one aperture and across a front side of said bag and through said two spaced apertures, said strap means extending from said two apertures across a rearward side of said bag and over the top of said bag to said one aperture.

2. A portable storage bag as in claim 1 including a single aperture in said closure flap and located centrally thereof.

3. A portable storage bag as in claim 2 wherein said strap means extends through said one aperture and terminates in a loop on said front side of said bag, said strap means further including two straps, each extending across said rearward side and through a respective one of said two spaced apertures and each defining a loop adjacent a front side of said bag.

4. A portable storage bag as in claim 3 further including shoulder harness means connected to said two straps for mounting said bag for carrying.

5. A portable storage bag as in claim 1 wherein said top closure is foldable and rollable, said closure flap extending thereover for holding said top closure in sealed condition.

6. A portable storage bag as in claim 1 wherein said strap means engages said front side and said bottom portion when said bag is filled, said strap means supporting said bag, when said bag is lifted by said strap means, by engagement with said bag sides, said bag resting on said straps.

7. A portable storage bag as in claim 1 wherein said strap means extends over a portion of said closure flap and compresses said top closure when said strap means is lifted from a rearward side of said bag.

8. A portable storage bag for use as a backpack, said bag having front and rear sides sealed along a portion of their edges, a bottom portion, and a top closure including a closure flap, said bag including:

two spaced apertures in said bottom portion of said bag, said apertures sealed off from the interior of said bag, at least one aperture in said closure flap, and strap means extending around said bag and through said apertures, said strap means supporting said bag by engagement of said strap means with said bottom portion and with said front side of said bag when said strap means are lifted from a rearward side of said bag, whereby said strap means cradle said bag and load therein.

9. A portable storage bag as in claim 8 wherein said top closure includes a folding portion, said closure flap extending over said foldable portions and having means to connect said closure flap to said front side of said bag for holding said folding portion in a sealing position, said strap means extending over a portion of said closure flap and through said one aperture and compressing said folding portion when said bag is lifted by said strap means from a rearward side of said bag.

10. A portable waterproof storage bag having two sides, a bottom and a top, said top having a closure flap, said bag further including:

two spaced apertures in a bottom portion of the bag, said apertures being spaced from an interior of said bag, at least one aperture in said closure flap, and encircling strap means extending through said one aperture and across a front side of said bag and through said two spaced apertures, said strap means extending from said two apertures across a rearward side of said bag and over the top of said bag to said one aperture.

11. A bag as in claim 10 wherein an operable bag closure is disposed along one side of said bag.

* * * * *